United States Patent [19]

Schulze

[11] Patent Number: 4,813,798

[45] Date of Patent: Mar. 21, 1989

[54] LIGHTING ARRANGEMENT FOR TYPEWRITERS OR PRINTERS

[76] Inventor: Siegfried M. Schulze, Rüdesheimer Strasse 33, 6222 Geisenheim, Fed. Rep. of Germany

[21] Appl. No.: 35,586

[22] PCT Filed: Jun. 30, 1986

[86] PCT No.: PCT/EP86/00384

§ 371 Date: Mar. 16, 1987

§ 102(e) Date: Mar. 16, 1987

[87] PCT Pub. No.: WO87/00124

PCT Pub. Date: Jan. 15, 1987

[30] Foreign Application Priority Data

Nov. 7, 1985 [DE] Fed. Rep. of Germany ... 8520058[U]

[51] Int. Cl.[4] ..... B41J 29/18

[52] U.S. Cl. ..... 400/716

[58] Field of Search ..... 400/690, 690.1, 690.2, 400/690.4, 691, 693, 716; 362/89

[56] References Cited

U.S. PATENT DOCUMENTS

| | | | |
|---|---|---|---|
| 1,727,377 | 9/1929 | Meinecke | 400/690.1 |
| 2,295,210 | 9/1942 | Gutensohn et al. | 362/89 |
| 2,670,834 | 3/1954 | Schroder | 400/690 |
| 2,800,573 | 7/1957 | Hudson | 362/89 |
| 3,135,372 | 6/1964 | Baughman | 400/690 |
| 3,548,184 | 12/1970 | Fletcher | 400/716 |
| 3,720,298 | 3/1973 | Alonas et al. | 400/716 |
| 4,355,914 | 10/1982 | Alexander | 400/690.1 |

FOREIGN PATENT DOCUMENTS

| | | | |
|---|---|---|---|
| 1917765 | 10/1970 | Fed. Rep. of Germany | 400/716 |
| 1272480 | 12/1961 | France . | |
| 0063490 | 4/1983 | Japan | 400/716 |
| 2076744 | 12/1981 | United Kingdom | 400/716 |

*Primary Examiner*—David A. Wiecking

*Attorney, Agent, or Firm*—Gifford, Groh, Sheridan, Sprinkle and Dolgorukov

[57] ABSTRACT

Described is a lighting arrangement for typewriters or printers, which is arranged on a light shade member (4, 14) above the printing or typing mechanism well. For that purpose a fluorescent tube (6) may be disposed in a separate tube (7) at the front edge of the light shade member (4) or it may be integrated into a thickened portion. A light exit window (8) is so disposed as to provide for dazzle-free lighting of the material being typed.

5 Claims, 2 Drawing Sheets

LIGHTING ARRANGEMENT FOR TYPEWRITERS OR PRINTERS

Figure 1:
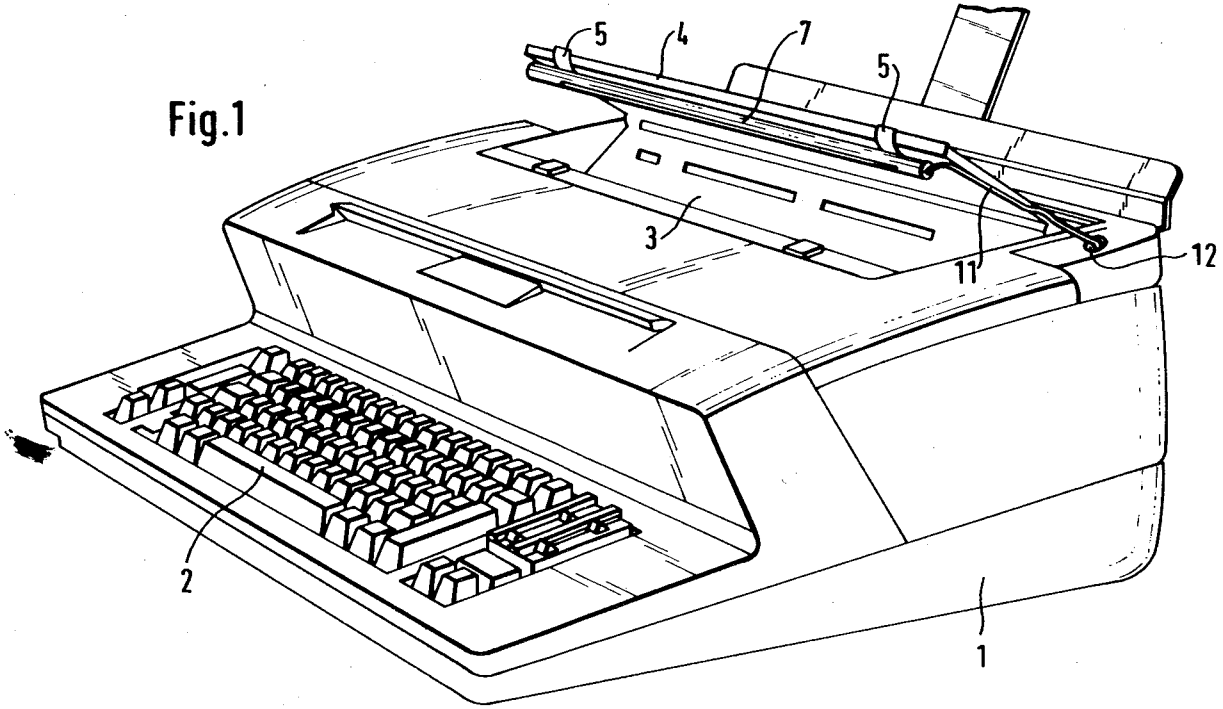

The invention relates to a lighting arrangement for typewriters or printers, comprising a light shade member arranged above the printing or typing mechanism well.

Typewriters and printers are quite generally subject to the requirement that they should be as quiet as possible in operation. While the walls of the casing of the typewriter or printer hold the sound back in a satisfactory manner and additional insulating steps can possibly be taken, the printing mechanism well or cavity which contains the paper feed arrangement with roller and guide rollers as well as a carriage with the printing mechanism represents a large sound-radiating opening. To provide a sound damping effect, that opening is usually closed by means of a transparent cover or shield of plastic material, for example acrylic glass. However, in that case reflection phenomena frequenty occur, which not only make it difficult to look into the arrangement but which can also cause troublesome reflections. Therefore, a pivotable light shade member of opaque plastic material or metal is generally additionally disposed above the covered typing mechanism well or cavity, wherein the light shade member can be adjusted in such a way as substantially to avoid reflection phenomena. Nonetheless it is generally difficult to have a view into the printing mechanism well so that reading of the typed text and following the progress of the typing operation are impeded. A similar situation also applies in regard to printers.

Attempts have already been made to improve the viewing situation in the printing mechanism well by mounting lamps in the printing mechanism well itself. In that respect however the angle of lighting is unfavourable so that the paper guide members throw shadows on to the paper precisely at the location where a free view is desired. In addition, there is only a very small amount of space available in the typing mechanism well so that it is not possible to dispose effective lighting therein. Lighting using a movable lamp which stands beside or behind the typewriter or printer also does not provide acceptable results because in most cases it is not possible to find a position of adjustment in which good lighting is achieved without the lamp itself impairing the view.

Accordingly, the object of the present invention is to provide a lighting arrangement for typewriters or printers, which in a simple manner provides for good lighting in the typing mechanism well, without itself constituting a nuisance.

To attain that object, the invention takes as its basic starting point a lighting arrangement of the kind set forth in the opening part of this specification, and is characterised in that arranged on the light shade member is an elongate lighting member which radiates light on to the typing area and which is shaded towards the eyes of the operator. When adjusting the light shade member, it is then possible at the same time to adjust the lighting effect and it is possible to provide that the material being typed is well lit without reflection and in such a manner as to be kind to the eyes. That is essentially also due to the fact that the lighting is effected from an area above the angle of view. As a result of that, the arrangement also does not produce any shadows from parts of the typing mechanism.

Further developments of the invention are the subject-matter of the subsidiary claims. Thus, the lighting member may be a fluorescent tube which is arranged in a tube of opaque material, wherein the tube has a light exit window directed towards the typing area. In that case only the typing area is lit and no dazzle phenomena occur. The use of a fluorescent tube gives the advantage that the amount of heat generated is small and the lighting arrangement causes scarely any nuisance because of the small diameter of commerically available fluorescent tubes. The tube is advantageously mounted rotatably about its axis so that the light exit window which is desirably in the form of a longitudinal slot can be conveniently adjusted. The lighting member is mounted at the front edge of the light shade member in a simple manner by means of two clamping loops or clips.

In a further aspect of the invention, in another embodiment, a lamp housing in the form of an elongate hollow space or cavity may be provided at the front free edge of the light shade member, in a thickened portion thereof, wherein disposed in the lamp housing is a fluorescent tube, preferably together with a starter, and the fluorescent tube radiates light through a light exit window on to the typing area. In that case the lighting member does not represent a separate component but is a constituent part of the light shade member, more particularly preferably in such a way that the lamp housing is at least partially formed in one piece with the light shade member. With a clever configuration and the use of a thin fluorescent tube, it is then scarely possible to notice that the light shade member includes a lighting arrangement. In addition, even an unskilled person can install the lighting arrangement by substituting it for the normal light shade member.

The fluorescent tube may be fixedly arranged in the lamp housing, for example by means of adhesive, so that in the event of replacement the entire light shade member has to be changed, although the light shade member may be a comparatively inexpensive plastic component. It may also be provided however that a shell portion of the lamp housing is removable and is fixed in position for example by clips so that the fluorescent tube and possibly the starter thereof can be changed.

So that a special light shade member with lighting arrangement does not have to be manufactured for each type of machine, a development of the invention provides that the light shade member has interchangeable edge portions for fixing to different types of typewriters or printers. In that case, it is only necessary to mount the appropriate fixing members for the respective machine, possibly after suitably matching the length of the light shade member.

The power supply cable for the lighting member may advantageously be passed through an opening into the casing of the typewriter or printer, while series devices or power supply units, for example a ballast, are disposed in the casing. The connection in the machine is advantageously downstream of the switch thereof so that the lighting arrangement can also be switched on and off at the same time as the machine or printer.

When using a fluorescent tube, a further development of the invention provides that the series or power supply unit thereof is arranged in a separate housing which has a connecting cable for the power supply and a plug socket for connecting the typewriter or printer as well as a connecting line to the fluorescent tube. In that case there is not need for an additional connecting socket. The housing may stand beside the typewriter but it may also desirably be provided with retaining members for fitting it to the typewriter, for example by engaging the retaining members into the ventilation slots at the rear of the typewriter. In addition a plug power pack or supply unit may also be used for the supply of power for the lighting arrangement.

Figure 2:
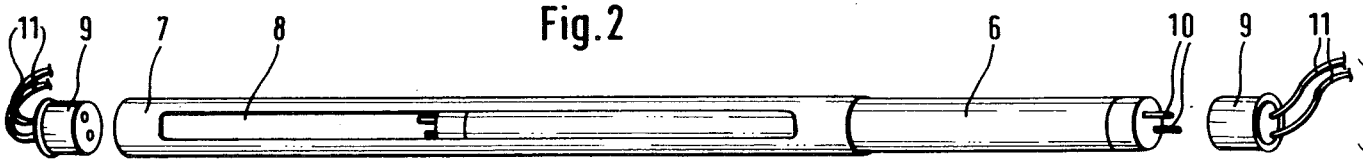
Figure 3:
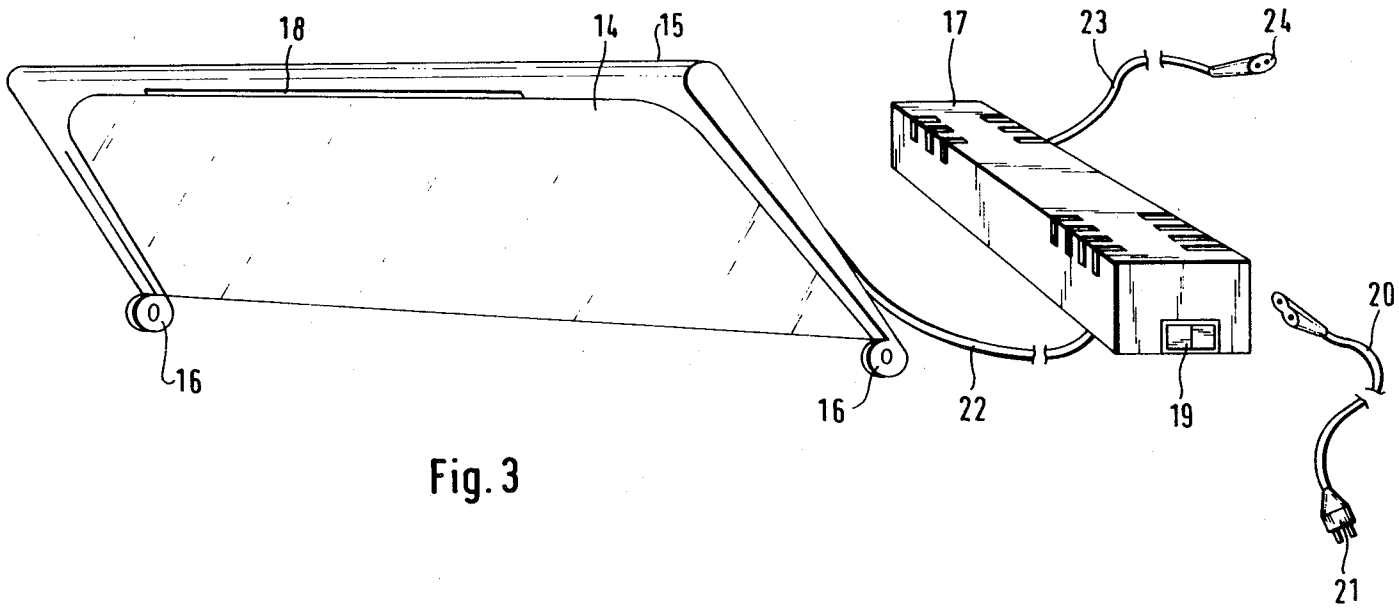

Embodiments of the invention will now be described with reference to the drawings in which:

FIG. 1 is a perspective view of a typewriter with a lighting arrangement as an embodiment of the invention, FIG. 2 is a view on an enlarged scale of the lighting arrangement shown in FIG. 1, and FIG. 3 shows a further embodiment of the invention in which the lighting arrangement is part of the light shade member.

The typewriter 1 with a conventional keyboard 2 has a cover 3 consisting of transparent material for the well or cavity containing the typing mechanism. A light shade member 4 having an inner surface facing cover 3, is pivotally mounted adjacent a rearward end of said light shade member to the rearward end of the cover 3 and extends upwardly over said cover. At its upper forward edge, by means of two S shaped clamping clips 5, the light shade member 4 carries a lighting arrangement the elongate lighting member in the form of a fluorescent tube 6 (see FIG. 2) which is fitted into a holder 7 having a slot-like light exit window 8. Socket holders 9 for the connecting pins 10 of the fluorescent tube 6 close off the holder 7 in the assembled condition of the arrangement. The power supply lines 11 which extend from the holders 9 are passed through an opening 12 into the casing of the typewriter 1. There is generally sufficient space at that location to mount the ballast (not shown) for the fluorscent tube 6. The electrical connection is desirably such that the on/off switch for the machine switches the lighting arrangement on and off at the same time.

By means of correct adjustment of the angle of inclination of the light shade member 4 and by rotation of the holder 7 and therewith the light radiation window 8, it is possible to provide good, dazzle-free lighting for the material being typed, independently of the outside light. The lighting arrangement itself may also be subsequently installed without a high level of expenditure by the respective customer service. Because of the low level of power consumption of the fluorescent tube 6, there is no troublesome generation of heat, with an unacceptable rise in the temperature of adjacent components.

In the embodiment shown in FIG. 3 the lighting arrangement is integrated into the light shade member 14. For that purpose, at the upper front edge the light shade member 14 has an elongated thickened portion forming the holder in which a fluorescent tube (not visible in the drawing) is arranged, together with the necessary starter. So that the thickened portion 15 is an unobtrusive as possible, the arrangement uses a fluorescent tube which is as thin as possible, together with the components of the starter, without a housing. A light exit window 18 in the form of a slot is so arranged as to provide good lighting of the material being typed, in the normal setting of the light shade member 14. To avoid dazzle, the inside of the light shade member 14 is of a matte black nature, for example by sticking a suitable film or foil thereto. For the purposes of fixing it to the typewriter 1, the light shade member 14 has fixing eyes 16 which are designed in the same manner as in the case of a normal light shade member. It is then easily possible even for an unskilled person to mount the light shade member 14 with lighting arrangement in position.

The ballast for the fluorescent tube is disposed in its own housing 17 which can stand beside the typewriter or which can be fixed to the rear side thereof, for example by means of push-in pins which are pressed into the ventilation slots in the typewriter. The housing 17 has a switch for switching the lighting arrangement on and off at 19. In order not to make it necessary to have an additional plug socket when installing the light shade member 14 with lighting arrangement, besides the connection of the ballast in the housing 17 by means of a connecting cable 20 with power supply plug 21 and the connection 22 to the fluorescent tube, there is a lead 23 with plug socket 24 which serves as the power supply for the typewriter.

I claim:

1. A lighting arrangement for typewriters or printers having a transparent sound deadening cover, a typing or printing mechanism well, a typing area, and a light shade member having an upper front free edge arranged above the typing or printing mechanism well and above and extending over said sound deadening cover characterized in that a lamp housing in the form of a member elongated along a predetermined axis forming a cavity elongated along said axis is provided at said front edge of said light shade member (14) in a thickened portion (15) thereof, said light shade member lamp housing having a light exit window elongated along said axis, and that disposed in the lamp housing is a flourescent tube, which radiates light onto said typing area through said light exit window (18), said housing being opaque except for said light exit window.

2. A lighting arrangement for a typewriter or printer including a typing mechanism, casing, and a switch having a transparent sound dampening cover (3) extending over a well containing the typing mechanism comprising, a light shade member (4, 14), said light shade member being pivotally mounted adjacent a rear end thereof relative to said cover and extending upwardly over said cover, said light shade member being adjustable with respect to said cover to reduce glare on said cover, said light shade member being dimensioned so that said light cover member extends over and substantially overlies said cover, said light shade member having an upper forward edge opposite said one end thereof and having an inner surface facing said sound-dampening cover, said arrangement further including a lighting member elongated along a predetermined axis including a holder elongated along said axis, a light producing member within said holder, said holder being opaque and having a slot-like exit window extending longitudinally along said axis in said holder; said holder being supported so as to extend along said inner surface of said light shade member adjacent said upper forward edge of said light shade member with said light exit window facing downward toward said cover, wherein said slot is arranged so that light from the lighting member is directed only towards said typing mechanism.

3. A lighting arrangement as set forth in claim 2 characterized in that the lighting member is fixed to said upper forward edge of the light shade member (4) by means of clamping clips (5).

4. A lighting arrangement as set forth in claim 2 characterized in that a power supply cable for the lighting member is passed through an opening (12) into said casing of the typewriter (1) or the printer so that said lighting member is operable by said switch.

5. A lighting arrangement as set forth in claim 2 characterized by the use of a fluorescent tube whose ballast is arranged in a separate housing (17) which has a connecting cable for the power supply and a plug socket for connection of the typewriter or printer and a connecting line to the fluorescent tube.

* * * * *

UNITED STATES PATENT AND TRADEMARK OFFICE

CERTIFICATE OF CORRECTION

PATENT NO. : 4,813,798

DATED : March 21, 1989

INVENTOR(S) : Siefried M. Schulze ET AL

It is certified that error appears in the above-identified patent and that said Letters Patent is hereby corrected as shown below:

On the title page:

[30] Change "Nov. 7, 1985" to --July 11, 1985--;

Signed and Sealed this

Twenty-seventh Day of March, 1990

*Attest:*

JEFFREY M. SAMUELS

*Attesting Officer*

*Acting Commissioner of Patents and Trademarks*